US006428455B1

(12) United States Patent
Sohl

(10) Patent No.: US 6,428,455 B1
(45) Date of Patent: Aug. 6, 2002

(54) RESILIENT ROLL

(75) Inventor: Carsten Sohl, Fredericia (DK)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/560,193

(22) Filed: Apr. 28, 2000

(30) Foreign Application Priority Data

Apr. 29, 1999 (DE) ..... 199 19 569

(51) Int. Cl.[7] ..... B23P 15/00

(52) U.S. Cl. ..... 492/50; 492/53; 492/56; 492/49

(58) Field of Search ..... 29/895; 492/50, 492/49, 53, 56

(56) References Cited

U.S. PATENT DOCUMENTS

| | | | | | |
|---|---|---|---|---|---|
| RE13,128 | E | * | 7/1910 | Perkins | 492/50 |
| 1,006,990 | A | * | 10/1911 | Warren | 492/50 |
| 2,959,119 | A | * | 11/1960 | Gould | 492/50 |
| 2,997,406 | A | * | 8/1961 | Freeman et al. | 492/50 |
| 3,395,636 | A | | 8/1968 | Hess | |
| 3,737,963 | A | * | 6/1973 | Postulka et al. | 492/50 |
| 3,800,381 | A | * | 4/1974 | Brafford | 492/50 |
| 3,852,862 | A | * | 12/1974 | Sukenik | 492/50 |
| 4,242,783 | A | * | 1/1981 | watanabe et al. | 492/50 |
| 4,576,845 | A | | 3/1986 | Krotchko | |
| 4,766,996 | A | * | 8/1988 | Gibson | 492/50 |
| 5,045,891 | A | * | 9/1991 | Senba et al. | 492/50 |
| 5,142,759 | A | | 9/1992 | Bonander et al. | |
| 5,334,124 | A | * | 8/1994 | Ohno | 492/50 |
| 5,378,219 | A | * | 1/1995 | Hart et al. | 492/53 |
| 5,387,172 | A | * | 2/1995 | habenicht et al. | 492/50 |

FOREIGN PATENT DOCUMENTS

| | | |
|---|---|---|
| DE | 1057056 | 10/1959 |
| DE | 1807331 | 6/1970 |
| DE | 2128294 | 1/1973 |
| DE | 3029288 | 3/1981 |
| DE | 29880097 | 9/1999 |
| EP | 0146342 | 6/1985 |
| EP | 655561 | 5/1995 |

OTHER PUBLICATIONS

Gamsjager, "Elastiche Kalanderwalzenbeziüge auf Basis Faser–Kunstsoff–Verbund", *Das Papier*, H. 6 (1994).

Patent Abstract of Japan JP 5–172133 A of M–1501, Oct. 25, 1993 vol. 17/No. 584.

* cited by examiner

*Primary Examiner*—I Cuda-Rosenbaum
(74) *Attorney, Agent, or Firm*—Greenblum & Bernstein, P.L.C.

(57) ABSTRACT

A roll for smoothing a web and a method of making the roll. The roll includes a roll core having an outer surface, and a covering layer disposed on the outer surface of the roll core, the covering layer having an inner surface, an outer surface, and a radial thickness. The covering layer includes a resilient matrix material and fillers embedded in the resilient matrix material, wherein the fillers include a plurality of elongated particles which have a length which is less than the radial thickness of the covering layer. The process includes providing a roll core having an outer surface, and applying a covering layer on the outer surface of the roll core, the covering layer having an inner surface, an outer surface, and radial thickness, the covering layer including a resilient matrix material and fillers embedded in the resilient matrix material, wherein the fillers include a plurality of elongated particles which have a length which is less than the radial thickness of the covering layer.

44 Claims, 1 Drawing Sheet

RESILIENT ROLL

CROSS-REFERENCE TO RELATED APPLICATIONS

Figure 1:
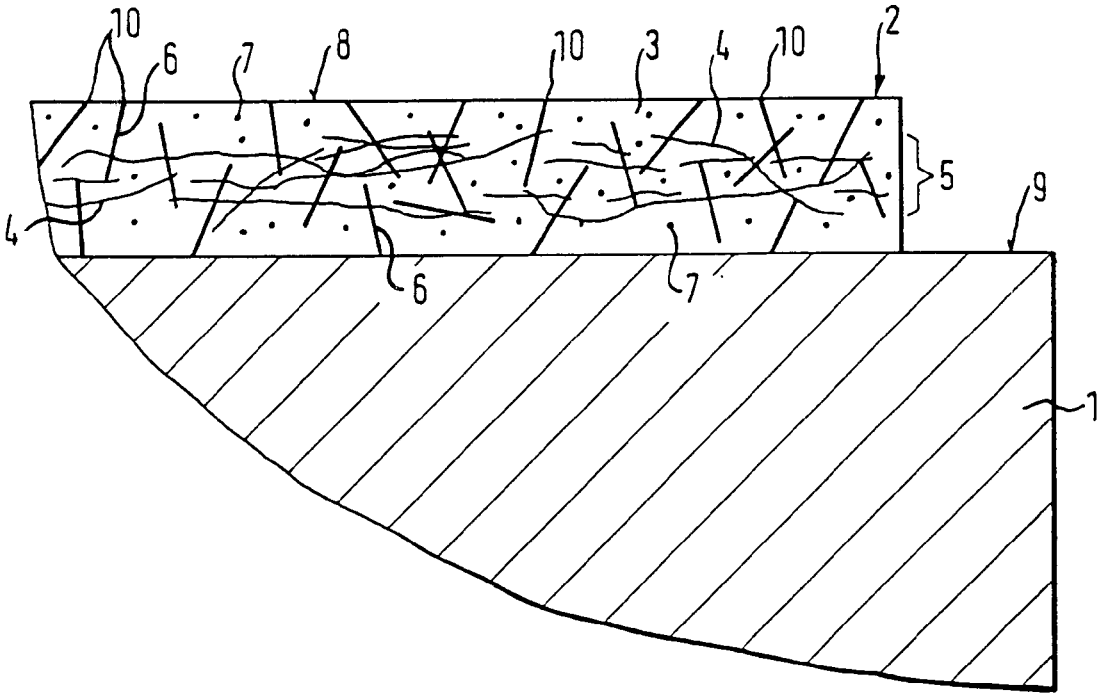

The present application claims priority under 35 U.S.C. § 119 of German Patent Application No. 199 19 569 2, filed on Apr. 29, 1999, the disclosure of which is expressly incorporated by reference herein in its entirety.

BACKGROUND OF THE INVENTION

1. Field of the Invention

The present invention relates to a roll of the type used for smoothing paper webs. The roll has a hard roll core which can be a metal and an outside surface utilizing a resilient covering layer. The covering layer may be a resilient matrix material with fibers embedded in the matrix material. Furthermore, the invention is directed to a process for producing such a roll.

2. Discussion of Background Information

Resilient rolls of this type are typically used, for example, in the calendering of paper webs. Such calenders often use an elastic roll together with a hard roll in forming a press nip. The paper web is calendered by feeding it through one or more of these nips. The hard rolls generally have a very smooth surface and are made of, for example, steel or hard cast iron. They function in smoothing that side of the paper web which faces it. Resilient rolls which act on the opposite side of the paper web have the effect of evening and compacting the paper web in the press nip. The resilience of this second or opposite roll in the nip acts to limit intensive compaction of the paper web, which would lead to a specky appearance of the paper web. Such rolls are generally large and typically have lengths of from 3 to 12 meters and diameters from 450 to 1500 mm. Moreover, they are designed to withstand line forces up to 600 N/mm and compressive stresses up to 130 N/mm$^2$.

The tendency in paper manufacture is for calendering to be carried out on-line, that is to say the paper web leaving the papermaking machine or coating machine is led immediately through the paper smoothing device (calender). This design places high requirements or demands on the rolls of the calender or smoothing device. In particular, this design subjects the rolls to higher temperatures so that they are require to have temperature resistance. The high transport speeds of the paper web, necessitated by on-line operation, and the associated high rotational speeds of the calender rolls increase the alternating flexure frequency of the rolls. It is these factors which in turn leads to increased roll temperatures.

These high temperatures which are produced in on-line operation lead to problems which, in the case of conventional resilient rolls, can lead to the destruction of the synthetic covering. Such conventional synthetic coverings can function only with a maximum temperature differences of about 20° C. over the width of the roll. Moreover, the polymers normally used for the roll coating have a significantly higher coefficient of thermal expansion than the steel rolls or hard cast rolls normally used. Thus, when there is an increase in the temperature of the rolls, high axial stresses occur between the steel roll or hard cast roll and the synthetic coating which is connected to it.

Moreover, such rolls also experience high stresses in localized regions of the roll due to these regions being heated more so than surrounding areas. Such hot spots in the synthetic coating can cause the synthetic layer to separate or burst from the metal roll.

These hot spots can occur when, in addition to the mechanical stresses and the relatively high temperatures experienced by the rolls, there are crystallization points in the form, for example, of faulty adhesive bonds between the layer and the metal. Additionally, deposits or above-avenge bulges in the resilient covering which result from creases or foreign bodies on the paper web can produce these hot spots or crystallization points. In these cases, the temperature of these crystallization points often rises from normally 80° C. to 90° C. to more than 150° C., which results in the aforementioned destruction of the synthetic layer.

In order to control the characteristics of the resilient covering layer, powered fillers and/or fibers may be introduced into the matrix material. Depending on the quantity as well as the physical characteristics of these fillers and/or the fibers, the physical characteristics of the resilient covering layer may be positively influenced by the fillers or the fibers.

The invention recognizes an effect which is normally undesired in calendering, referred to as black calendering, which is used for the production of transparent paper. In this production process, rolls with covering layers of higher stiffness are typically used, so that the fibers of the paper web introduced into the press nip collapse due to the increased pressure. This increased pressure accordingly produces the desired transparency.

Moreover, it is true that a general increase in the stiffness of the covering layer increases the probability of the uniform application of pressure in the press nip and that this can produce the desired transparency. However, the same general increase in the stiffness of the covering layer can also result in a reduction in the quality of the transparent paper.

SUMMARY OF THE INVENTION

The present invention therefore provides a process for producing a resilient roll of the aformentioned type. Moreover, the invention is also directed to a corresponding roll. Additionally, the roll of the invention is designed to withstand the formation or occurrence of hot spots. Further, the roll should be suitable for the production of high-quality transparent paper.

According to the invention, the roll utilizes at least some fillers which are formed as elongated, and in particular rod-like particles. Moreover, it is preferred that the length of the particles are less than the radial thickness of the resilient covering layer. A corresponding process according to the invention utilizes at least one filler in the form of elongated, and in particular rod-like particles, which are introduced into the resilient matrix material. Again, it is preferred that their length is less than the radial thickness of the resilient covering layer.

Both the thermal conductivity and the stiffness of the resilient covering layer can be improved by utilizing the elongated particles which are introduced into the matrix material. Because of the increased thermal conductivity, the excessive heat which typically occurs at critical points, can be dissipated more rapidly. As a result, even when parts of the covering experience critical temperatures, the occurrence of hot spots can be prevented. In this regard, in particular, the elongated formation of the particles is advantageous for rapid dissipation of heat from the critical points. Moreover, these may be, for example, in the direction of the roll core.

The elongated form of the particles also provides an advantage when those particles are aligned essentially in the radial direction, since this acts to increase the stiffness of the resilient covering layer at certain points. As a result of utilizing the elongated particles, the resilient covering layer will have a large number of points of increased stiffness.

By tailoring the covering design to the specific requirement of the paper, the transparent paper can be produced more efficiently with an appropriately equipped roll.

Moreover, by utilizing a length of the particles which is less than the radial thickness of the resilient covering layer, the elongated particles will not extend from the surface of the covering layer. Additionally, the resilient covering will take advantage of the regions between individual particles which are free of the particles, so that a certain resilience of the covering layer is maintained. As a result, the quality of the transparent paper produced can be increased when compared to completely rigid coating.

Likewise, in the axial direction of the roll, between point-like rigid points, there may be resilient regions which are essentially free of the fillers, so that given a uniform distribution of the elongated particles both in the radial and in the axial direction within the covering layer is maintained. Of course, one can optimize a combination of stiffness and resilience by varying the amount and type of fillers as well as the material of the matrix.

However, such an optimized combination cannot be achieved with the known powdered filling materials, which consist of essentially round particles. Nor is improved thermal conductivity provided by the known filler materials, since each of the essentially round particles is included in a thermally poorly conducting matrix material, in such a way that the dissipation of heat, for example in the direction of the roll core, is essentially not provided for at all.

The elongated particles formed in accordance with the invention preferably have a length to thickness ratio of between approximately 20:1 and approximately 5:1, and in particular of approximately 15:1 and approximately 7:1, and preferably of approximately 10:1. By utilizing these preferred ratio values, an ideal combination can be achieved between stiffness and resilience of the covering layer.

The elongated particles may further be advantageously essentially randomly distributed in the radial and/or axial direction, so as to achieve a uniform stiffness with a uniform resilience of the covering layer over the length of the roll.

In addition, a predominant proportion of the elongated particles in the matrix material may be essentially aligned in the radial direction, so that the stiffness of the resilient covering layer is defined by the predominant proportion of the particles. It is also possible for the particles to be arranged essentially randomly distributed in the matrix material, that is to say aligned uniformly in all directions. In this case, the stiffness of the covering layer may be lower, but the thermal conductivity of the covering layer in the axial direction may be advantageously increased.

According to a one embodiment of the invention, the particles are formed of thermally conductive material such that the thermal conductivity of the particles are higher than that of the matrix material. Depending on the quantity of particles introduced or utilized, the thermal conductivity of the covering layer can be increased. In this way, the dissipation of excess heat within the covering layer to the metallic roll core can be carried out in particular by the elongated particles aligned in the radial direction, so that undesired heat within the covering layer can be dissipated more rapidly to the roll core and laterally via the latter. Moreover, it should be noted that the particles forming the fillers can all be produced from the same material or from different materials.

According to another embodiment of the invention, the coefficient of thermal expansion of the particles can be lower than that of the matrix material. This design achieves the situation where the overall coefficient of thermal expansion of the covering layer is lower than that of the matrix material, so that the overall coefficient of thermal expansion can be matched to the coefficient of thermal expansion of the roll core. As a result, the longitudinal stresses between the covering layer and the roll core, which can occur in the event of heating of the roll, can be reduced.

According to another embodiment of the invention, some of the particles can extend radially outwards as far as the surface of the resilient covering layer. In this case, the elongated particles can already be accordingly introduced into the covering layer, so-that they extend as far as its surface. On the other hand, if the surface of the covering layer is ground down in order to produce a high surface smoothness, it is preferable that the elongated particles be set back from the surface the covering layer. After the surface has been ground down, the ends of the elongated particles can be finally exposed at the surface, so that they form the desired stiffness locations at certain points.

Advantageous values for average lengths of the elongated particles according to the invention can lie between approximately 200 and approximately 600 $\mu$m, and preferably between approximately 300 and approximately 500 $\mu$m, and most preferably at approximately 400 $\mu$m. The elongated particles therefore may have a length which is considerably below the length of the fibers. Moreover, these fibers may be, for example, carbon fibers which are provided in the resilient covering layer as reinforcing layers. The particles may preferably comprise wollastonite and/or calcium silicate. However, other materials may be utilized which have desirable or comparable characteristics.

It is preferable that, in addition to the particles, the fibers are also embedded in the matrix material. Additionally, these fibers can be applied to the roll core in rovings or as a nonwoven fiber which can serve to reinforce the resilient covering layer.

According to another embodiment of the invention, the fibers are arranged in radially successive fiber layers. These fiber layers can be spaced apart from one another or they can simply rest directly on one another. In addition, in the resilient covering layer there may be between approximately 5 and approximately 100, and preferably between approximately 20 and approximately 70, and most preferably between approximately 30 to approximately 40 fiber layers. Depending on the thickness of the resilient covering layer, however, more or fewer fiber layers can also be provided.

The fiber layers produce a reinforcement of the resilient covering layer, since a covering layer which consists of only matrix material usually does not have the stiffness required for calendering. If the resilient covering layer is formed from a number of fiber layers, however, there is the risk that, given an inadequate connection between the individual fiber layers, there will be a tendency for the fiber layers to separate.

However, if the elongated particles are arranged between the individual fiber layers (e.g., bridging the fiber layers), such a separation tendency can be counteracted. Accordingly, it preferable that at least some of the elongated particles be aligned radially in order to provide an additional connection between the individual fiber layers. Thus, in addition to the increased point-by-point stiffness for black calendering, and the improved thermal conductivity and the balancing coefficients of thermal expansion, the service life of a covering layer formed in accordance with the invention can also be improved by a reduced separation tendency.

According to one aspect of the invention there is provided a roll for smoothing a web comprising a roll core having an outer surface, and a covering layer disposed on the outer surface of the roll core, the covering layer having an inner surface, an outer surface, and a radial thickness, the covering layer comprising a resilient matrix material and fillers embedded in the resilient matrix material, wherein the fillers comprise a plurality of elongated particles which have a length which is less than the radial thickness of the covering layer. The web may be a paper web. The roll core may comprise a hard metal roll core. At least some of the plurality of elongated particles may comprise rod-like particles. At least some of the plurality of elongated particles may comprise a length to thickness ratio of between approximately 20:1 and approximately 5:1. At least some of the plurality of elongated particles may comprise a length to thickness ratio of between approximately 15:1 and approximately 7:1. At least some of the plurality of elongated particles may comprise a length to thickness ratio of approximately 10:1.

At least some of the plurality of elongated particles may be essentially randomly distributed in the resilient matrix material in one of a radial and an axial direction. At least some of the plurality of elongated particles are aligned substantially in a radial direction. A majority of the plurality of elongated particles may be aligned substantially in a radial direction. At least some of the plurality of elongated particles may be randomly aligned. At least some of the plurality of elongated particles may be randomly aligned in one of an axial and a radial direction. At least some of the plurality of elongated particles may comprise a thermally conductive material. The thermally conductive material may have a thermal conductivity which is higher than a thermal conductivity of the resilient matrix material.

At least some of the plurality of elongated particles may be substantially radially oriented so as to extend substantially to the inner surface of the covering layer. At least some of the plurality of elongated particles may be substantially radially oriented so as to extend substantially to the outer surface of the roll core. At least some of the plurality of elongated particles may comprise a coefficient of thermal expansion which is lower than a coefficient of thermal expansion of the resilient matrix material. At least some of the plurality of elongated particles may have a higher stiffness than the resilient matrix material. At least some of the plurality of elongated particles may be substantially radially oriented so as to extend substantially to the outer surface of the covering layer. At least some of the plurality of elongated particles may have an average length of between approximately 200 and approximately 600 $\mu$m. At least some of the plurality of elongated particles may have an average length of between approximately 300 and approximately 500 $\mu$m. At least some of the plurality of elongated particles may have an average length of approximately 400 $\mu$m. At least some of the plurality of elongated particles may comprise one of wollastonite and calcium silicate.

The covering layer may further comprise fibers which are embedded in the resilient matrix material. At least some of the fibers may be arranged in a fiber layer. At least some of the fibers may be arranged in a plurality of radially successive fiber layers. At least two of the plurality of radially successive fiber layers may be spaced apart from one another. At least two of the plurality of radially successive fiber layers may be spaced apart from one another and spliced to one another. At least some of the plurality of radially successive fiber layers may be disposed adjacent one another.

The plurality of radially successive fiber layers may comprise between approximately 5 and approximately 100 layers. The plurality of radially successive fiber layers may comprise between approximately 20 and approximately 70 layers. The plurality radially successive fiber layers may comprise between approximately 30 and approximately 40 layers. At least some of the plurality of elongated particles may be arranged between at least two radially successive fiber layers. At least some of the plurality of elongated particles may be arranged between and extend into at least two radially successive fiber layers.

The covering layer may further comprise a radially outer functional layer and a radially inner connecting layer. The radially inner connecting layer may connect or couple the functional layer to the roll core. At least some of the plurality of elongated particles may be arranged in the functional layer. At least some of the plurality of elongated particles may be arranged in one of the functional layer and the radially inner connecting layer. At least some of the fibers may comprise one of glass fibers and carbon fibers.

The resilient matrix material may comprise a polymer. The polymer may comprise one of a thermosetting polymer and a thermoplastic polymer. The resilient matrix material comprises one of a resin and a hardener. The resilient matrix material may comprise a resin and a hardener.

The invention also provides for a process for making a roll for smoothing a web comprising providing a roll core having an outer surface, and applying a covering layer on the outer surface of the roll core, the covering layer having an inner surface, an outer surface, and radial thickness, the covering layer comprising a resilient matrix material and fillers embedded in the resilient matrix material, wherein the fillers comprise a plurality of elongated particles which have a length which is less than the radial thickness of the covering layer. The web may be a paper web. The roll core may comprises a hard metal roll core. The covering layer may further comprise fibers which are embedded in the resilient matrix material.

The applying may further comprise winding at least one fiber bundle comprising a plurality fibers onto the roll core. The applying may further comprise winding a plurality of fiber bundles onto the roll core, wherein each fiber bundle comprising a plurality fibers.

The plurality fiber bundles may form fiber layers which are disposed one above another. At least some of the plurality of elongated particles may be disposed between adjacent fiber layers. At least some of the plurality of elongated particles may be disposed between a fiber layer and the outer surface of the roll core. At least some of the plurality of elongated particles may be disposed between a fiber layer and the inner surface of the covering layer. At least some of the plurality of elongated particles may be disposed between a fiber layer and the outer surface of the covering layer. The at least one fiber bundle may comprise one of at least one fiber roving and at least one nonwoven fiber. The at least one fiber bundle may comprise at least one fiber roving. The at least one fiber roving may comprise a plurality identical type fibers which are arranged adjacent one another. The at least one fiber bundle may comprise at least one nonwoven fiber.

The applying may further comprise applying matrix material to at least one fiber bundle comprising a plurality fibers, and winding the at least one fiber bundle onto the roll core. The applying matrix material may comprise drawing the at least one fiber bundle through a bath of matrix material. The bath of matrix material may comprise a plurality of elongated particles. The winding may comprise introducing a plurality of elongated particles into the matrix material. The winding may comprise introducing a plurality of elongated particles into the matrix material.

The applying may farther comprise winding at least one fiber bundle comprising a plurality fibers onto the roll core, and applying matrix material to the at least one fiber bundle. The applying matrix material may occur after the winding. The matrix material may comprise a plurality of elongated particles. The winding may comprise introducing a plurality of elongated particles into the matrix material. The winding may comprise introducing a plurality of elongated particles into the matrix material.

At least some of the fibers may comprise one of glass fibers and carbon fibers.

The invention also provides for a roll for smoothing a web comprising a hard metal roll core having an outer surface, a resilient covering layer having an inner surface, a middle region, and an outer surface, the inner surface being affixed to the outer surface of the hard metal roll core, the resilient covering layer comprising a resilient resin matrix material and a plurality of fillers and fibers which are embedded in the matrix material, the fillers comprising a plurality of rod-like particles wherein at least some of the plurality of rod-like particles are arranged substantially radially, the fibers comprising a plurality of one of glass fibers and carbon fibers, wherein at least some of the rod-like particles extend substantially to one of the outer surface of the covering layer and the inner surface of the covering layer. At least some of the fibers may be arranged axially. The fillers may also comprise a plurality of quasi-spherical particles.

The invention further provides for a process for making a roll for smoothing a web comprising providing a hard metal roll core having an outer surface, and applying a resilient covering layer having an inner surface, a middle region, and an outer surface, to the outer surface of the hard metal roll core, the resilient covering layer comprising a resilient resin matrix material and a plurality of fillers and one of glass fibers and carbon fibers embedded in the matrix material, wherein at least some of fillers comprise rod-like particles which extend substantially to one of the outer surface of the covering layer and the inner surface of the covering layer. The applying may comprise winding at least one fiber bundle comprising a plurality fibers onto the roll core. The middle region may comprises a plurality of fiber layers. The middle region may comprise at least two fiber layers and at least one matrix material layer disposed between the at least two fiber layers.

BRIEF DESCRIPTION THE DRAWINGS

Figure 2:
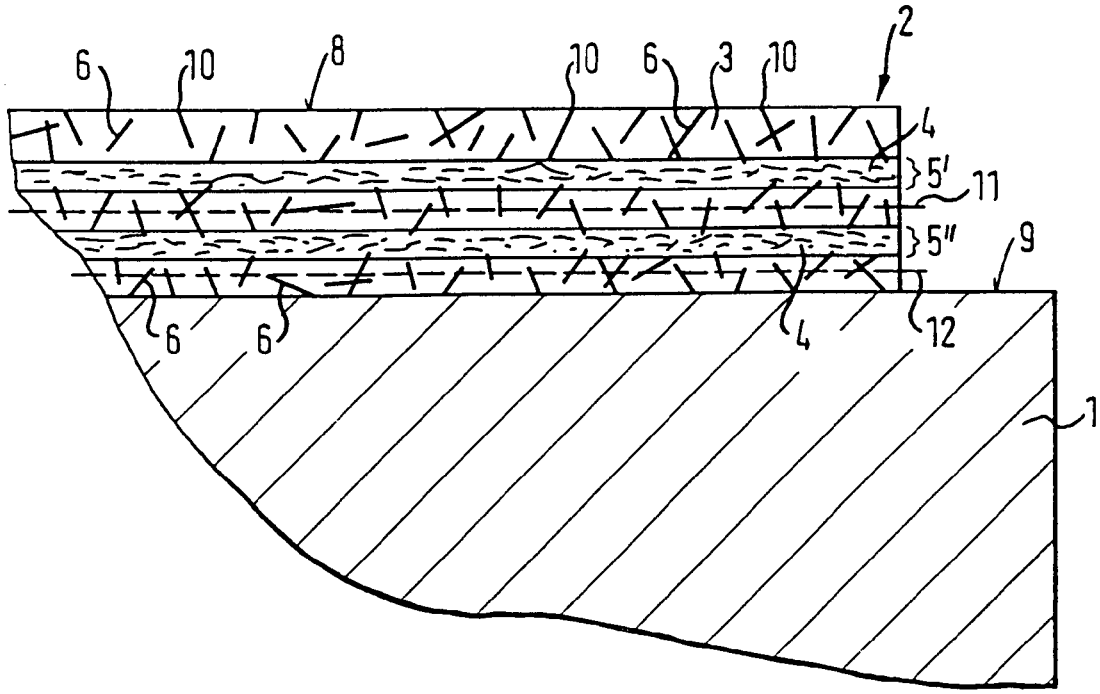

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 1 shows a partial longitudinal section through a roll constructed in accordance with the invention with a resilient covering layer; and FIG. 2 shows a further embodiment of a roll constructed in accordance with the invention.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIG. 1 shows part of a roll core 1, which is sectioned in the longitudinal direction. Roll core 1 may be made of steel or hard cast iron, for example, and is provided on its outer side or surface with a resilient covering layer 2, likewise illustrated in section.

Covering layer 2 includes a resilient matrix material 3 which can be a resin/hardener combination. Additionally, covering layer 2 further includes a large number of fibers 4 which are embedded therein. Fibers 4 can be, for example, carbon fibers or glass fibers or a mixture of carbon and glass fibers. Of course, other fibers may also be utilized. Fibers 4 are aligned essentially in the axial direction of roll core 1 and form a fiber layer 5. This layer 5 may be applied by being wound onto roll core 1. By utilizing fibers 4, the stiffness of covering layer 2 is increased or improved by comparison with a covering layer which includes only a pure polymer or matrix. Additionally, fibers 4, especially when these are carbon fibers, can also be utilized to improve the thermal conductivity in the axial direction.

In addition to fibers 4, fillers of one or more types are provided in resilient matrix material 3. These fillers may comprise elongated, rod-like particles 6 as well as fine-grained fine particles 7. While fine particles 7 are essentially formed quasi-spherically and may have a diameter of approximately 10 to approximately 20 $\mu$m, for example, elongated rod-like particles 6 may have a length of approximately 400 $\mu$m. Some of elongated particles 6 in each case can be arranged to extend with one end as far as surface 8 of covering layer 2, while other elongated particles 6 can be arranged to extend with their respective end as far as surface 9 of roll core 1. All elongated particles 6 are, however, preferably formed in such a way that their length is shorter than the radial thickness of covering layer 2.

Elongated particles 6 which extend as far as the surface 8 of covering layer 2 are designed to form, at surface 8, point-like locations of increased stiffness. Moreover, these points should be uniformly distribution if elongated particles 6 are similarly distributed. This design should produce uniform increased stiffness points over the entire surface 8. In particular if there is an essentially radial alignment of particles 6, the stiffness of covering layer 2 at locations 10 is increased considerably when compared with other regions such as those having only matrix material. In this way, the roll illustrated in FIG. 1 can be used for the production of transparent paper.

Since the length of particles 6 is designed to be shorter than the radial thickness of covering layer 2, an increase in the stiffness is in each case provided only in some regions along the length of the respective particles 6. Accordingly, over the entire thickness of covering layer 2, a certain desired resilience can be maintained. This is because even in the case of precisely radially aligned particles 6, there is in each case a certain amount of flexible matrix material 3 between their lower ends and the surface of roll core 1. As a result of the combination illustrated of elongated rod-like particles 6 and resilient matrix material 3 in the manner illustrated in FIG. 1, an optimal combination between point-by-point stiffness and global resilience of the covering layer can be achieved.

In addition, elongated particles 6 can act to increase the thermal conductivity of the covering layer 2, when particles 6 have a better thermal conductivity than the matrix material 3. In this case, particles 6 extending in the radial direction or obliquely in particular, increase the thermal conductivity of covering layer 2 in the radial direction, so that in addition to the thermal conductivity in the axial direction being improved by the fibers layer 5, the result is also an improvement in a direction aligned perpendicular to this.

If overheating locations occur at certain points within covering layer 2, e.g., so-called hot spots, then the undesired heat can be dissipated in the radial direction along elongated particles 6 to roll core 1, and thereafter from roll core 1 axially. The invention also contemplates that the heat supplied to roll core 1 can be channeled or led radially inwards in order either to be dissipated axially in the interior of the roll core 1 by a cooling medium present in the interior of roll core 1.

Heat transfer in the axial direction essentially takes place via the fibers 4 of the fiber layer 5 as a result of fibers 4 being aligned essentially in the axial direction. However, undesired heat can also be dissipated perpendicular thereto via the elongated particles 6. This is in particular advantageous since the undesired heat can be dissipated from covering layer 2 significantly more rapidly in the radial direction. This is because the thickness of covering layer 2 is typically between approximately 1 mm and approximately 3 cm, while the axial length is much greater at between approximately 2 m and 12 m. Accordingly, timely dissipation of undesired heat in the axial direction via fiber layer 5 is virtually impossible because of this great axial length of covering layer 2.

Moreover, if particles 6 are chosen from a material which has a coefficient of thermal expansion, such as one that is similar to the material of roll core 1, then the overall coefficient of thermal expansion of covering layer 2 can approach that of the coefficient of expansion of roll core 1. This applies in particular when a large number of particles 6 are arranged to run obliquely or essentially in the axial direction. Since matrix material 3 normally has a considerably higher coefficient of thermal expansion than roll core 1, the reduction in the overall coefficient of thermal expansion of covering layer 2, on the basis of elongated particles 6, can reduce the longitudinal stresses occurring between roll core 1 and covering layer 2 in the event of heating of the roll.

Point-like fine particles 7 can likewise be used to adapt the coefficient of thermal expansion of covering layer 2 to the coefficient of thermal expansion of roll core 1. Additionally, these can define other desired physical characteristics of covering layer 2. However, if appropriate and/or desired, fine particles 7 can also be omitted completely.

Fiber layer 5 may be produced or manufactured, for example, by winding fiber rovings or nonwoven fiber onto roll core 1. One example of this may be seen more clearly in FIG. 2, where two fiber layers 5', 5" are spaced apart radially from each other and are illustrated schematically. In this case, before being wound, the fibers or fiber rovings can have matrix material 3 in the liquid state applied to them, for example by being drawn through a bath of matrix. However, it is also possible for the fibers or the fiber rovings to be wound dry onto roll core 1 and to be impregnated with matrix material either before or after the winding operation, until they are completely surrounded by the said matrix material. In order to achieve a smooth surface 8 of the roll after the winding procedure, the uppermost layer of the matrix material 3 is preferably ground down. This will allow the large number of elongated particles 6 to appear at surface 8 and thus form point-like locations 10 of increased stiffness.

The two fiber layers 5', 5" may be connected to each other by matrix material 3, with lower fiber layer 5" likewise being connected to surface 9 of roll core 1 by matrix material 3. Moreover, covering layer 2 can be made very stable in the region of fiber layers 5', 5", because of inter-engaging fibers 4, e.g., in the regions indicated by dashed lines 11, 12, between fiber layers 5' and 5". This can also take place, respectively, between fiber layer 5" and surface 9 of roll cover 1. This design reduces the risk that, in the event of appropriate loading, detachment of covering layer 2 from roll core 1 or from the two subareas of covering layer 2 containing fiber layers 5', 5" from each other, will take place.

As a result of utilizing elongated rod-like particles 6, the connection between the different sub-layers in covering layer 2 is improved precisely in the threatened regions 11, 12. Elongated particles 6 act to form reinforcing links in the radial direction, so that the overall stability of covering layer 2 in the radial direction is increased considerably. As a result of this design, the above-described separation tendency therefore does not arise in the case of a covering layer 2 constructed in accordance with the invention.

Additionally, as a result of the improvement in the dissipation of heat, it is possible to produce larger nip widths, which further improves the quality of the treated paper web.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Symbol

1 Roll core
2 Covering layer
3 Matrix material
4 Fibers
5,5',5" Fiber layers
6 Elongated rod-like particles
7 Fine particles
8 Surface of the covering layer
9 Surface of the roll core
10 Point-like locations
11 Dashed line
12 Dashed line

What is claimed is:

1. A roll for smoothing a web comprising:

a roll core having an outer surface; and a covering layer disposed on the outer surface of the roll core, the covering layer having an inner surface, an outer surface, and a radial thickness;

the covering layer comprising a resilient matrix material and fillers embedded in the resilient matrix material, wherein the fillers comprise a plurality of elongated particles which have a length which is less than the radial thickness of the covering layer, wherein the plurality of elongated particles have a stiffness which is higher than a stiffness of the resilient matrix material, wherein the plurality of elongated particles are substantially radially oriented so as to provide a large number of points of increased stiffness in the covering layer, and wherein at least some of the plurality of elongated particles comprise a thermally conductive material whose thermal conductivity is higher than a thermal conductivity of the resilient matrix material.

2. The roll of claim 1, wherein the web is a paper web.

3. The roll of claim 1, wherein the roll core comprises a hard metal roll core.

4. The roll of claim 1, wherein at least some of the plurality of elongated particles comprise rod-like particles.

5. The roll of claim 1, wherein at least some of the plurality of elongated particles comprise a length to thickness ratio of between approximately 20:1 and approximately 5:1.

6. The roll of claim 5, wherein at least some of the plurality of elongated particles comprise a length to thickness ratio of between approximately 15:1 and approximately 7:1.

7. The roll of claim 6, wherein at least some of the plurality of elongated particles comprise a length to thickness ratio of approximately 10:1.

8. The roll of claim 1, wherein at least some of the plurality of elongated particles are essentially randomly distributed in the resilient matrix material in one of a radial and an axial direction.

9. The roll of claim 1, wherein a majority of the plurality of elongated particles are aligned substantially in a radial direction.

10. The roll of claim 1, wherein at least some of the plurality of elongated particles are randomly aligned.

11. The roll of claim 1, wherein at least some of the plurality of elongated particles are randomly aligned in one of an axial and a radial direction.

12. The roll of claim 1, wherein at least some of the plurality of elongated particles are substantially radially oriented so as to extend substantially to the inner surface of the covering layer.

13. The roll of claim 1, wherein at least some of the plurality of elongated particles are substantially radially oriented so as to extend substantially to the outer surface of the roll core.

14. The roll of claim 1, wherein at least some of the plurality of elongated particles comprise a coefficient of thermal expansion which is lower than a coefficient of thermal expansion of the resilient matrix material.

15. The roll of claim 1, wherein at least some of the plurality of elongated particles have a higher stiffness than the resilient matrix material.

16. The roll of claim 1, wherein at least some of the plurality of elongated particles are substantially radially oriented so as to extend substantially to the outer surface of the covering layer.

17. The roll of claim 1, wherein at least some of the plurality of elongated particles have an average length of between approximately 200 and approximately 600 $\mu$m.

18. The roll of claim 17, wherein at least some of the plurality of elongated particles have an average length of between approximately 300 and approximately 500 $\mu$m.

19. The roll of claim 18, wherein at least some of the plurality of elongated particles have an average length of approximately 400 $\mu$m.

20. The roll of claim 1, wherein at least some of the plurality of elongated particles comprise one of wollastonite and calcium silicate.

21. The roll of claim 1, wherein the covering layer further comprises fibers which are embedded in the resilient matrix material.

22. The roll of claim 21, wherein at least some of the fibers are arranged in a fiber layer.

23. The roll of claim 21, wherein at least some of the fibers are arranged in a plurality of radially successive fiber layers.

24. The roll of claim 23, wherein at least two of the plurality of radially successive fiber layers are spaced apart from one another.

25. The roll of claim 23, wherein at least two of the plurality of radially successive fiber layers are spaced apart from one another and spliced to one another.

26. The roll of claim 23, wherein at least some of the plurality of radially successive fiber layers are disposed adjacent one another.

27. The roll of claim 23, wherein the plurality of radially successive fiber layers comprises between approximately 5 and approximately 100 layers.

28. The roll of claim 27, wherein the plurality of radially successive fiber layers comprises between approximately 20 and approximately 70 layers.

29. The roll of claim 28, wherein the plurality radially successive fiber layers comprises between approximately 30 and approximately 40 layers.

30. The roll of claim 23, wherein at least some of the plurality of elongated particles are arranged between at least two radially successive fiber layers.

31. The roll of claim 23, wherein at least some of the plurality of elongated particles are arranged between and extend into at least two radially successive fiber layers.

32. The roll of claim 1, wherein the covering layer further comprises a radially outer functional layer and a radially inner connecting layer.

33. The roll of claim 32, wherein the radially inner connecting layer connects or couples the functional layer to the roll core.

34. The roll of claim 33, wherein at least some pf the plurality of elongated particles are arranged in the functional layer.

35. The roll of claim 33, wherein at least some pf the plurality of elongated particles are arranged in one of the functional layer and the radially inner connecting layer.

36. The roll of claim 21, wherein at least some of the fibers comprise one of glass fibers and carbon fibers.

37. The roll of claim 1, wherein the resilient matrix material comprises a polymer.

38. The roll of claim 37, wherein the polymer comprises one of a thermosetting polymer and a thermoplastic polymer.

39. The roll of claim 1, wherein the resilient matrix material comprises one of a resin and a hardener.

40. The roll of claim 1, wherein the resilient matrix material comprises a resin and a hardener.

41. A roll for smoothing a web comprising:

a hard metal roll core having an outer surface;

a resilient covering layer having an inner surface, a middle region, and an outer surface, the inner surface being affixed to the outer surface of the hard metal roll core;

the resilient covering layer comprising a resilient matrix material and a plurality of fillers and fibers which are embedded in the resilient matrix material;

the fillers comprising a plurality of rod-like particles wherein at least some of the plurality of rod-like particles are arranged substantially radially;

the fibers comprising a plurality of one of glass fibers and carbon fibers, wherein at least some of the rod-like particles extend substantially to one of the outer surface of the covering layer and the inner surface of the covering layer.

42. The roll of claim 41, wherein at least some of the fibers are arranged axially.

43. The roll of claim 41, wherein the fillers comprise a plurality of quasi-spherical particles.

44. A roll for smoothing a web comprising:

a roll core having an outer surface; and a covering layer disposed on the outer surface of the roll core, the covering layer having an inner surface, an outer surface, and a radial thickness;

the covering layer comprising a resilient matrix material and fillers embedded in the resilient matrix material, wherein the fillers comprise a plurality of elongated particles which have a length which is less than the radial thickness of the covering layer, whereby the plurality of elongated particles are substantially radially oriented so as to provide a large number of points of increased stiffness in the covering layer, and wherein the fillers also comprise a plurality of fine grain particles.

* * * * *